United States Patent [19]

Gross et al.

[11] 4,021,640

[45] May 3, 1977

[54] INSULATED GLOVE CONSTRUCTION

[75] Inventors: Alexander Louis Gross, Aspen, Colo.; Erik O. Giese, Key Biscayne, Fla.

[73] Assignee: Comfort Products, Inc., Aspen, Colo.

[22] Filed: July 30, 1975

[21] Appl. No.: 600,422

[52] U.S. Cl. ..... 219/211; 2/159; 2/161 R; 2/167; 128/381; 219/527

[51] Int. Cl.[2] ..... H05B 1/00

[58] Field of Search ..... 219/211, 527–529; 126/204; 128/379, 381; 2/158, 159, 161, 164, 167

[56] References Cited

UNITED STATES PATENTS

| | | | |
|---|---|---|---|
| 1,538,263 | 5/1925 | Ackerman | 2/164 X |
| 2,840,823 | 7/1958 | Kita | 2/158 |
| 3,292,628 | 12/1966 | Maxwell et al. | 128/402 |

*Primary Examiner*—C. L. Albritton
*Attorney, Agent, or Firm*—Pennie & Edmonds

[57] ABSTRACT

An insulated glove construction having a strip of mesh-like insulation material extending over the front, back and tip portions of each of the fingers and of the thumb of the glove and positioned between outer and inner linings making up the glove body. Heating means may be provided to warm the tips of the front of the fingers and the tip of the front of the thumb of the glove. Battery means may be carried in the glove body to provide a source of energy for the heating means.

8 Claims, 6 Drawing Figures

INSULATED GLOVE CONSTRUCTION

BACKGROUND OF THE INVENTION

Insulated gloves and mittens have been proposed which include heating means to provide comfort to the wearer under extreme frigid conditions. See, for example, the heated mittens disclosed in U.S. Pat. No. 3,621,191. A difficulty with the prior art gloves and mittens has been that the heating means were distributed throughout the glove or mitten body so as to provide heating of the complete hand. This resulted in heating portions of the hand, such as the palm, which is relatively less sensitive to cold than other parts, such as the tips of the fingers, with the overall result that electrical energy was wasted in heating parts of the hand not requiring heat for comfort. Since batteries used to provide the electrical source were of limited capacity, such overall heating would often result in premature exhaustion of the energy of the batteries.

Further, gloves of the prior art in an attempt to provide sufficient insulation would often include excessive amounts of insulation material distributed throughout the glove body resulting in an over-size, unwieldy member which impeded movement of the wearer's hand.

It is an objective of our invention to provide for an insulated glove construction which takes into account that certain portions of the hand are more sensitive to cold than other portions, to provide effective insulation for those portions without impeding movement of the wearer's hand, and where necessary, to provide a heating means which will only heat those portions of the hand most sensitive to cold, and thus to utilize a minimum of electrical energy while still providing the necessary degree of comfort to the wearer.

GENERAL DESCRIPTION OF THE INVENTION

Broadly, our invention comprises a glove construction where an outer lining, such as a leather-like material, and an inner lining have a mesh-like insulation strip positioned therebetween to extend over the front, back and tip of each of the finger portions as well as of the thumb portion. The mesh strip itself comprises a plastic-like material having two woven fabric-like materials separated by a corrugated material. The properties of the plastic material, including the corrugated material, are such as to withstand considerable compression forces. The strips may be encased in a thin plastic foil material so that a plurality of non-collapsible air impervious cells are formed which in turn provides a further insulation barrier between the inner and outer linings. In one form of the invention, the space in the cells within the strips may be evacuated to form a partial vacuum to still further reduce any conductive effect of heat between the inner and outer linings.

Electrical resistance elements in the form of printed circuits are included at the front tips of the finger and thumb portions to provide heating in that area only as this is the area of the hand most sensitive to cold. Electrical leads extend from the resistance elements to rechargeable battery means carried on the glove which provide a source of electrical power. In order that electrical energy will only be utilized when heating is needed or desired, a selective switch is included on the glove in order that the batteries may be selectively connected to the electrical means. A light emitting diode is included in the circuitry to indicate when the batteries are connected.

DESCRIPTION OF THE PREFERRED EMBODIMENT

Figure 1:
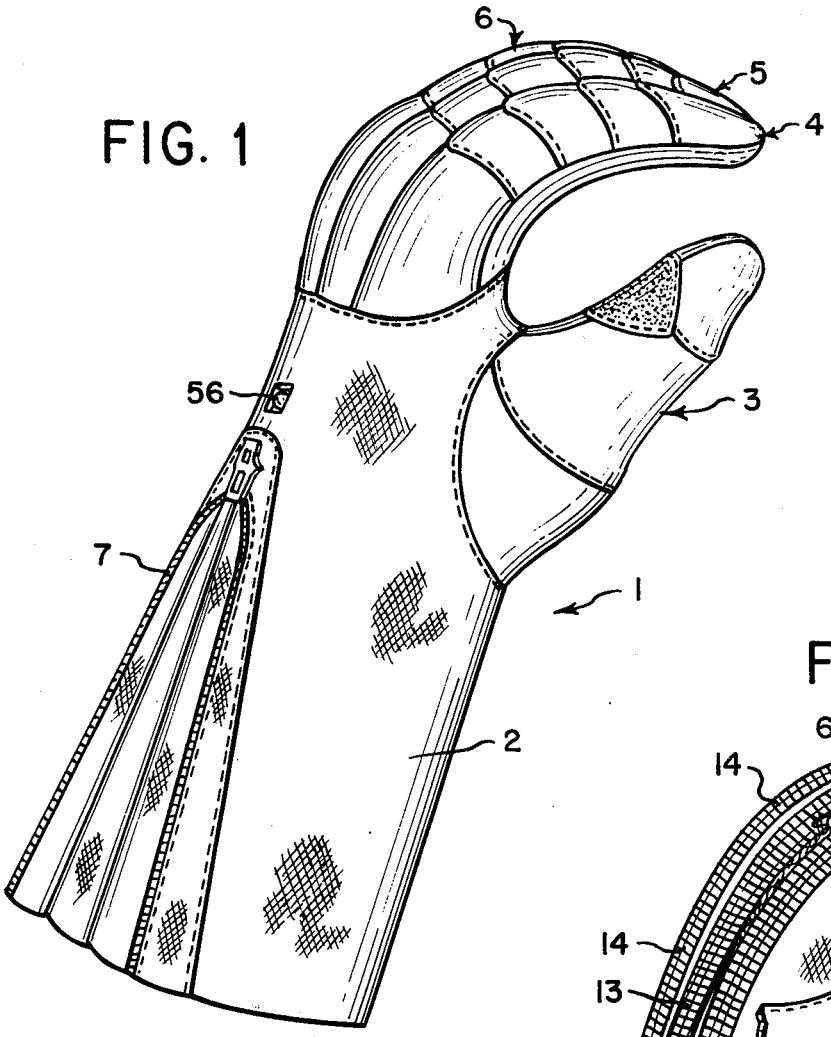
FIG. 1 is a side view of a glove constructed according to our invention.

Referring to FIG. 1, there is illustrated a glove constructed according to the invention comprising an outer covering 1, preferably leather, made up of a gauntlet portion 2, a thumb portion 3 and individual finger portions 4, 5, and 6 with the last or little finger portion not being illustrated. The glove has a zipper 7 thereon in order that the gauntlet portion may be securely affixed to the lower part of the wearer's arm.

Figure 2:
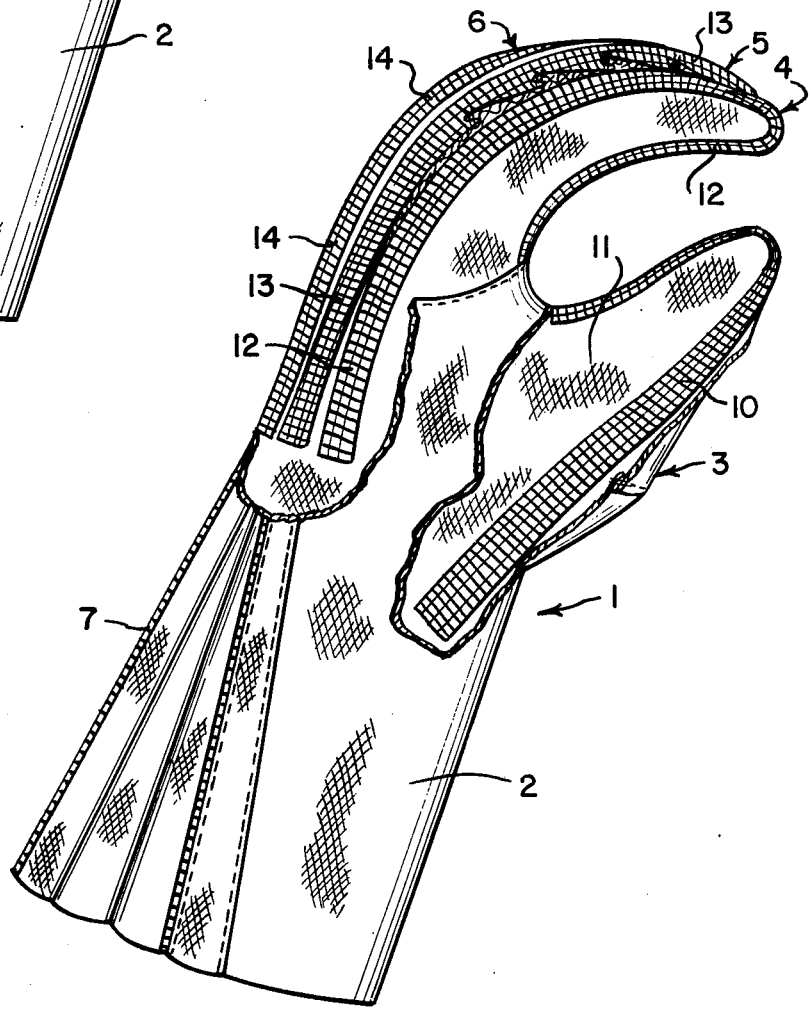
FIG. 2 is a view similar to FIG. 1 with a portion of the actual lining removed to reveal the inner lining and insulation strips.

Referring to FIG. 2, the glove as shown has an insulation strip 10 which is mounted on the inner liner 11 of the glove and extends around the front, tip and back of the thumb portion 3. Similar strips 12, 13 and 14 extend around the finger portions 4, 5 and 6 so as to cover the front, tip and back of the fingers. The strips may be affixed to the inner liner which comprises a fabric or pile material by an adhesive.

Figure 3:
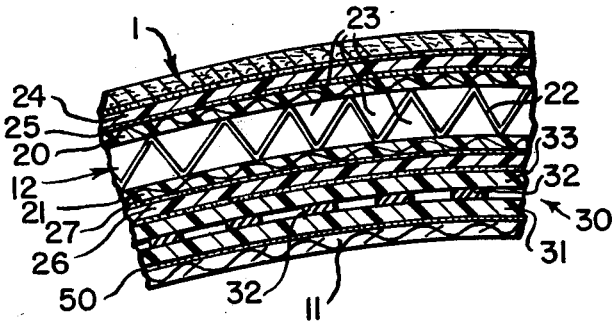
FIG. 3 is an enlarged cross-section of a part of a finger portion of the glove of FIG. 1.

As shown in FIG. 3, the strip 12 comprises two mesh-like fabrics 20 and 21 which are separated by a corrugated monofilament 22. Preferably, the mesh-like fabrics and corrugated monofilament comprise a plastic material, for example, saran. The plastic material is of such a strength that when formed into strips it will resist deformation applications of a compressive force. The spacing of the mesh-like fabrics 20 and 21 by the corrugated member 22 produce a plurality of air cells or pockets 23 which provide an insulation barrier.

In order to increase the insulation properties of the strip 12, a film of the plastic material 24 may be affixed to the mesh-like fabric 20 by a layer of adhesive 25 while a similar film 26 may be affixed to the mesh-like fabric 21 by a layer of adhesive 27. The films 24 and 26 preferably comprise a saran or polyethylene material having heat sealing characteristics such that the films may be sealed together around their peripheries to enclose the strips 12 therebetween and to provide dead air spaces within the cells 23. The cells 23 may be partially evacuated of air to produce a vacuum or the cells may be filled with a gas having less heat conduction properties than air to further increase the insulation properties.

It has been found that the use of the insulation strips as described provides a sufficient degree of insulation under most climatic conditions resulting in comfort to the wearer. Since the strips only extend around the portions of the hand most sensitive to the cold, that is the front, tips and back of the fingers and thumbs, overall massiveness of the glove is reduced resulting in a minimum of impedement. Further, since the strips extend over the fronts and backs of the fingers and thumbs, they may bend along the joint lines of the fingers and thumbs.

Figure 4:
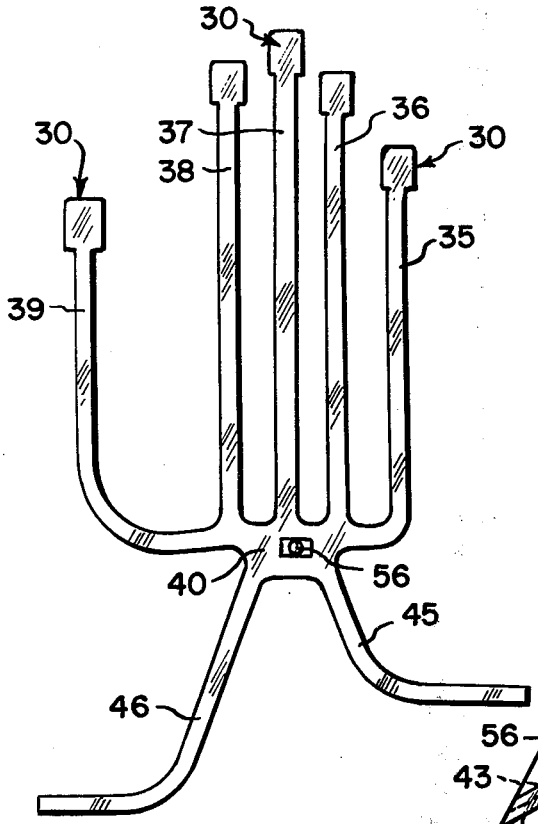
FIG. 4 is a plan view of the heating elements as may be included in the glove of FIG. 1.
Figure 6:
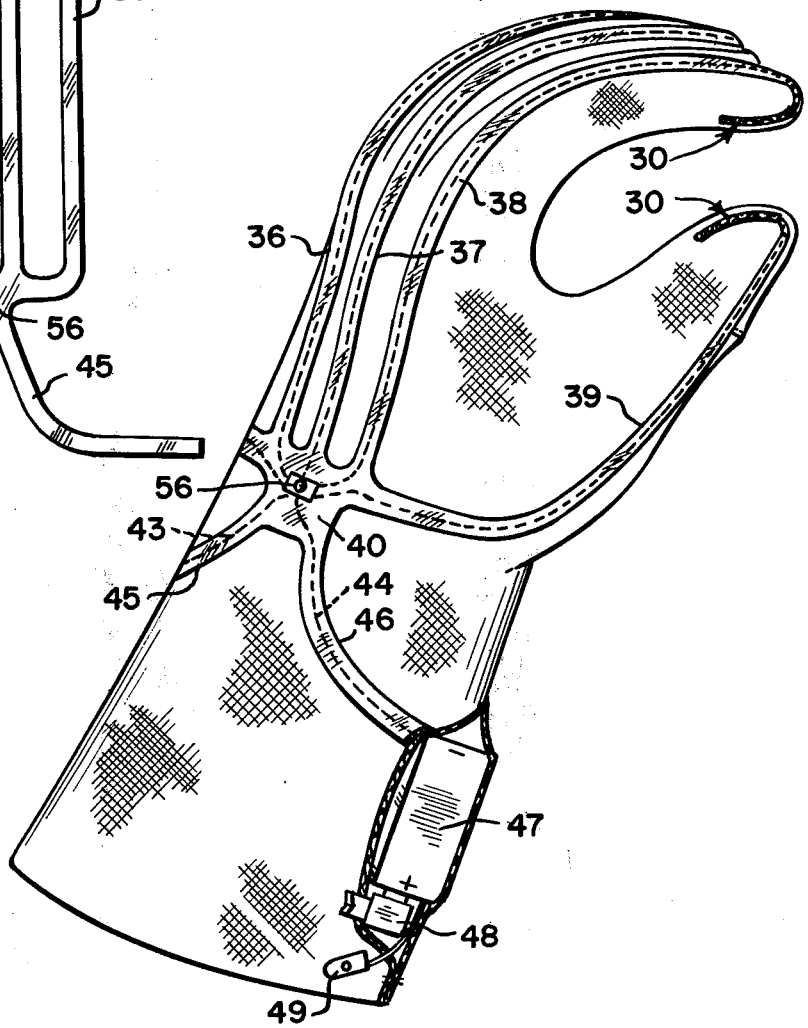
FIG. 6 is a view of the glove of FIG. 1 with the outer lining and insulation strips removed to reveal the positioning of the heating elements and associated circuitry.
Figure 5:
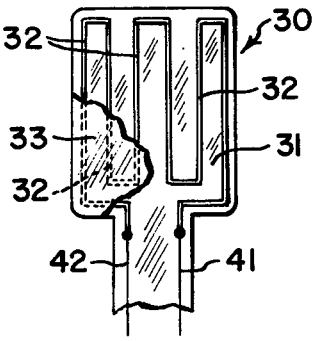
FIG. 5 is an enlarged plan view of a portion of FIG. 1 illustrating a sample heating element in closer detail.

In extreme frigid conditions, it may be desirable to include a heating means in the glove such that the tips of the faces of the fingers and thumb may be heated. Referring to FIG. 3–6, and particularly to FIG. 3, a heating means 30 for one finger is disclosed which comprises a plastic film 31, i.e., mylar having an electrical circuit 32 printed thereon which provides a resistance heating element. The heating element 32 may be overlayed by further film 33 so that the heating element may be conveniently inserted in the glove construction without fear of shorting. As shown in FIG. 4, the mylar strips containing the heating elements have extensions 35–39 which extend to the finger and thumb portions and which are joined together at a center portion 40. Each element 32 is connected by leads 41 and 42 contained between the two layers of mylar. These leads extend to the central portion 40 to a common junction to join leads 43 and 44 which in turn are carried in extensions 45 and 46 to a rechargeable battery 47 contained within a pocket of the gauntlet as shown in FIG. 6. Battery 47 is provided with a switch 48 such that the leads 43 and 44 may be selectively connected to the battery, the battery also has a recharging plug 49 through which it may be connected to a recharger. It has been found that in many instances it is only necessary to connect the battery to the heating elements for a short period of time to provide the necessary heating. This use of energy in short periods of time rather than a continued use results in a prolonged life of the battery before recharging becomes necessary.

In order to provide an indication when the battery is connected to the heating elements a light emitting diode 56 is included in the circuitry which will illuminate when the battery is connected.

As shown in FIG. 6, the heating elements extend only over the front of the tip portions of the fingers and of the thumb. It has been found that when these areas are warmed that a sufficient degree of comfort is provided for the complete hand. This further reduces drain on the battery 47 since only those portions of the hand most susceptible to cold are heated.

As shown in FIG. 3, the film 31 is secured to the inner liner 11 by means of adhesive layer 50. Liner 11 may comprise a fabric or a pile material and preferably the material of the pile or fabric is hydrophobic which reduces moisture accumulation in the glove structure and thus increases comfort.

While the FIG. 3 construction includes a heating element, the invention contemplates a glove construction without heating elements wherein the inner liner would be joined by adhesive directly to the insulation strip. Further, although the FIG. 3 construction discloses encasing the insulation strip within the films 24 and 26, the invention further contemplates that these films could be dispersed with so that the outer covering would contact the mesh-like fabric 20 directly and the inner liner the mesh-like fabric 21.

We claim:

1. An insulated glove construction comprising an outer covering, an inner liner material extending over the finger portions and the thumb portion of said glove construction, and a separate strip of mesh material between the inner lining material and outer covering extending over the back, front and end of each of the finger portions and of the thumb portion.

2. An insulated glove construction according to claim 1 wherein each said strip comprises two layers of a woven fabric-like material separated by a corrugated material and a film of plastic material overlying each layer of woven fabric-like material to form a plurality of non-collapsible air-impervious cells within the strip.

3. An insulated glove construction according to claim 2 wherein said cells are air evacuated to form vacuum chambers.

4. An insulated glove construction according to claim 2 having in addition electrical heating elements between said inner liner material and the strip of mesh material at the front sides of the end of each finger portion and the thumb portion, and electrical leads extending from said heating elements to a battery means.

5. An insulated glove construction according to claim 4 wherein said heating elements each comprise a first plastic layer, a conductive circuit printed on said first plastic layer and a second plastic layer overlying said conductive circuit.

6. An insulated glove construction according to claim 1 wherein said inner liner material comprises a hydrophobic pile material.

7. An insulated glove construction according to claim 4 having in addition switch means for selectively connecting said battery means to said electrical leads.

8. An insulated glove construction according to claim 7 having in addition indicator means for indicating when said battery means are connected to said electrical leads.

* * * * *